United States Patent [19]

Ahuja

[11] 4,332,843

[45] Jun. 1, 1982

[54] METALLIC INTERNAL COATING METHOD

[75] Inventor: Pritam L. Ahuja, West Chester, Ohio

[73] Assignee: General Electric Company, Cincinnati, Ohio

[21] Appl. No.: 246,345

[22] Filed: Mar. 23, 1981

[51] Int. Cl.[3] ..... C23C 13/02

[52] U.S. Cl. ..... 427/237; 427/250; 427/252; 427/253

[58] Field of Search ..... 427/237, 250, 252, 253

[56] References Cited

U.S. PATENT DOCUMENTS

| | | | |
|---|---|---|---|
| 3,598,638 | 8/1971 | Levine | 117/107.2 P |
| 3,667,985 | 6/1972 | Levine et al. | 117/22 |
| 3,837,901 | 9/1974 | Seybolt | 427/253 |
| 3,900,613 | 8/1975 | Galmiche et al. | 427/237 |
| 3,951,642 | 4/1976 | Chang et al. | 427/253 X |
| 4,031,274 | 6/1977 | Bessen | 427/229 |
| 4,208,453 | 6/1980 | Baldi | 427/237 |

*Primary Examiner*—James R. Hoffman

*Attorney, Agent, or Firm*—Lee H. Sachs; Derek P. Lawrence

[57] ABSTRACT

A method for applying a metallic coating to inner wall surfaces of a fluid-cooled turbomachinery blading member employs a substantially dry coating powder mixture which includes inert filler powder having a nonuniform powder size blend and a coating powder source which reacts with a halide activator to generate a coating vapor. The coating powder mixture is retained within a portion of the blading member during heating to generate the vapor. Blading members can be repaired and fluid-cooling passage exit openings can be resized.

7 Claims, No Drawings

METALLIC INTERNAL COATING METHOD

BACKGROUND OF THE INVENTION

1. Field of the Invention

This invention relates to metallic coatings for internal surfaces and, more particularly, to a method and powder mixture for applying a metallic coating to the internal surface of an article from the coating powder mixture which generates a coating vapor.

2. Description of the Prior Art

During high temperature operation, turbomachinery blading members such as turbine blades, vanes, nozzles, etc., which are fluid cooled such as through use of air in internal fluid-cooling passages, have experienced oxidation and sulfidation reactions on the internal surfaces of such cooling passages. Therefore, it has been recognized that there is a need to apply an internal coating to such components which generally are made of superalloys based on the elements Ni or Co or both.

Coating of such internal surfaces through the use of a fluid which contacts the inner surface while the fluid is passed through an article to be coated has been described for example in connection with such patents as U.S. Pat. No. 4,031,274-Bessen issued June 21, 1977. In addition, the coating of such internal surfaces through the use of a slurry or a powder mixture held within the internal portion of an article and in contact with the surface to be coated have been described in such U.S. Pat. Nos. as 3,900,613-Galmiche et al, issued Aug. 19, 1975 and 4,208,453-Baldi issued June 17, 1980.

Although such known methods can be used to apply various coatings to the internal surfaces of certain articles, it is difficult to control coating deposition when moving fluid through the complex air-cooling passages of a turbomachinery blade member, as well as to provide adequate thickness or to obtain the type of coating desired for a high temperature application. In the case of wet and dry pack coating materials required to be applied against the surface to be coated, known materials are difficult to remove because they have a tendency to agglomerate or sinter together. Accordingly, the removal of such material from within a complex array of passages within an air-cooled turbomachinery blading member is very difficult. Retention of such pack material within the member after coating can inhibit or block cooling fluid flow through the member.

SUMMARY OF THE INVENTION

It is a principal object of the present invention to provide a metallic internal coating method which uses an improved, substantially dry coating powder mixture for use within a turbomachinery blading member and which is easily removable after application of the coating.

Another object is to provide an improved coating powder mixture for use in such a method.

These and other objects and advantages will be more clearly understood from the following detailed description which is intended to be typical of rather than in any way limiting on the scope of the present invention.

Briefly, the present invention provides an improved substantially dry coating powder mixture for use in a method for applying a metallic coating to a fluid-cooled turbomachinery blading member of an alloy based on Co, Ni or their mixtures and which includes an end portion and an airfoil portion connected with the end portion. The airfoil portion includes an inner wall surface which defines a fluid-cooling passage; the end portion includes an end panel which communicates with the fluid-cooling passage. In such a method, the metallic coating is deposited from a coating powder mixture which comprises a coating source powder, a halide activator and an inert filler powder. The method of the present invention provides the coating powder mixture with alumina as the inert filler powder in the range of 80–98 weight percent of the mixture and with a nonuniform powder size blend which varies predominantly within the range of +325 mesh to −140 mesh to avoid sintering or agglomeration of the coating powder mixture. Such a mixture is disposed in the end channel, adjacent to the fluid-cooling passage. The powder mixture is mechanically retained in the end channel, for example using a metal foil, sheet, cap, etc., after which the article and mixture are heated in a nonoxidizing atmosphere at a temperature and for a time sufficient to react the coating source powder with the activator. Thus, there is generated from the coating source powder a coating vapor within the end channel. Such coating vapor passes into the fluid-cooling passage where it contacts the passage inner wall surface to deposit thereon the metallic coating.

DESCRIPTION OF THE PREFERRED EMBODIMENTS

Application of metallic coatings using a pack diffusion type method has been discussed in the literature and in a number of patents such as U.S. Pat. No. 3,667,985-Levine et al issued June 6, 1972 and in U.S. Pat. No. 3,598,638-Levine issued Aug. 10, 1971. Such patents describe the use of a coating powder mixture including a coating source powder, a halide activator and an inert powder as a filler material in which the other particulate or powder materials are distributed. In the 3,667,985 patent, the method includes contacting the article surface with the particulate mixture; in the 3,598,638 patent, the article surface and the coating source material are maintained in a spaced apart relationship. A variety of types of coating source powders have been described, for example in such U.S. Pat. No. as 3,837,901-Seybolt, issued Sept. 24, 1974, and U.S. Pat. No. 3,951,642-Chang et al issued Apr. 20, 1976. The disclosures of each of these patents is incorporated herein by reference.

As has been discussed above, the use of a coating powder mixture which includes a coating source powder disposed in contact with an inner surface of an air-cooled turbomachinery blading member such as a blade, vane, nozzle, etc. presents a problem in respect to removal of such a coating powder mixture after coating. It has been recognized that known coating powder mixtures have a tendency to sinter or agglomerate within the interior of relatively narrow internal passages within such a member. In order to avoid such sintering or agglomeration, the inert filler such as alumina has been provided in the prior methods in very fine particle sizes in order to increase the fluidity of the mixture after coating. However, the resulting dense mixture inhibits the migration of coating vapor; hence, the application of coating to a desired thickness for such turbomachinery blading members is too long for practical commercial manufacture. Use of very large particle sizes results in too rapid a deposition.

One feature of the present invention is the recognition that the use of a nonuniform size distribution for the inert powder filler material inhibits sintering or agglomeration of the powder mixture and provides a practical rate of coating vapor efflux from the coating powder mixture. Another feature of the present invention is the disposition of the coating powder mixture predominantly very closely adjacent rather than within the internal fluid-cooling passages of a turbomachinery blading member. This enables the coating vapor, generated by reaction of the halide activator with the coating source powder, to contact the surface to be coated without traveling over distances in which the vapor can become contaminated. For example, even though such diffusion coating methods are conducted in nonoxidizing atmosphere, there are residual materials in the nonoxidizing gases which can contaminate the coating vapor. Thus, two important features of the method of the present invention are the provision of the inert filler powder in a nonuniform powder size blend within a particular range along with the disposition of the coating powder mixture within the article but adjacent a surface which is to be coated.

During the evaluation of the present invention, a variety of coating powder mixtures and blends of inert filler materials were considered. Of particular interest were the powders and methods for generating an aluminide coating as described in the above-identified U.S. Pat. Nos. 3,667,985 and 3,837,901, which have become known in the art, respectively, as the CODEP coating method and the CODAL coating method. Preferred is the use of $Fe_2Al_5$ compound described in the U.S. Pat. No. 3,837,901. Its use is preferred because of its relatively high aluminum activity.

Used in the evaluation was a gas turbine engine air-cooled turbine blade of the type described in more detail in U.S. Pat. No. 3,628,885-Sidenstick et al, issued Dec. 21, 1971, the disclosure of which is incorporated herein by reference. Such a turbine blade includes, within its airfoil, fluid-cooling passages which communicate with chambers or channels within the root portion, such channels being open through the inner or base end of the turbine blade. Practice of the method of the present invention includes disposing a substantially dry coating powder mixture within the end or root channels after which the mixture is mechanically retained within such channel such as by holding or securing a metallic strip or cap over the end openings. Commercially available Ni Cr alloy is useful for such purpose. Then the article and the coating powder mixture thus disposed are heated in a nonoxidizing atmosphere to bring about generation of a coating vapor for deposition on and diffusion into inner walls, particularly the air-cooling passages of the airfoil portion, which are remote from the disposed and retained coating powder mixture.

As was discussed above, one of the problems in conducting such an internal coating method is the subsequent removal of the coating powder mixture. Thus sintering, agglomeration or adherence of the powder to the internal walls is to be avoided and can be detrimental to the operation of the article. The present invention recognizes that a nonuniform powder size blend within the range of +325 mesh to −140 mesh not only can provide ease of removal of the powder mixture from within an article to be coated but also can enable control of the coating rate. The residue remaining after practice of the present invention is soft and easily removed. Removal can be by vibration and, if desired, flushing with a liquid, for example 40% sulfuric acid aqueous solution at about 200° F.

As was mentioned before, a preferred coating source powder to provide an internal aluminide coating, according to the method of the present invention, is a powder of alloy $Fe_2Al_5$ because of its high aluminum activity. During the evaluation of the present invention, a powder of such an alloy in the size range of +325 mesh to −140 mesh was evaluated in various coating powder mixtures consisting essentially of, by weight, about 2–20% coating source powder; about 80–98% alumina, provided as a nonuniform powder blend in the size range of +325 mesh to −140 mesh; and about 0.1–1% $NH_4F$ halide activator, typical of a variety of halide activators commonly used in this aspect of the coating art and described in a variety of the above-incorporated patents. In these evaluations, it was recognized that less than about 2% $Fe_2Al_5$ generated too thin a coating, with about 2% generating a coating of about 0.0005" thickness. At about 20% of $Fe_2Al_5$ as the coating source powder, a coating thickness of about 0.002" was generated. Greater than about 20% of such coating source powder did not appreciably increase the coating benefit.

In respect to the halide activator used with the $Fe_2Al_5$, it was recognized that a concentration of below about 0.1% does not provide enough activity of the fluoride ion to vaporize Al from the coating source powder. The Al deposition rate levels off between 0.1 and 0.2% activator. Above about 1% activator, the activity is too great and the rapidly generated Al tends to agglomerate or lump together. The range of about 0.1–0.5% activator is preferred for the deposition of Al.

In another portion of the evaluation of the present invention using an inert filler in the above-described nonuniform powder size blend, the coating source powder was powdered Al metal, identified as Research Al-100%, with a mixture of $AlF_3$ and $NH_4F$. The mixture also included the above-described alumina nonuniform powder blend as the inert filler.

In still a further evaluation of the present invention, Cr powder was evaluated as the coating source. It was recognized that, according to the method of the present invention, chromium powder should be included in the range of 2–10 weight percent. It has been recognized that less than about 2% Cr results in too thin a coating, for example less than 0.1 mils. Greater than about 10% Cr results in an excess of Cr in the form of alpha chromium. It was recognized that larger amounts of halide activator are required for the practical deposition of Cr metal. For example, $NH_4Cl$ was preferred in the range of about 5–10 weight percent in a coating powder mixture of 2–10% Cr, with the balance alumina in the above-described nonuniform size blend. The range of 5–10% Cr is needed to generate a coating thickness in the range of about 0.2–0.3 mils. In one example, a coating powder mixture, by weight, of 5% Cr powder, 5% $NH_4Cl$ powder, with balance $Al_2O_3$ in the nonuniform blend in the range of +325 mesh to −140 mesh was used to apply a Cr coating in the temperature range of 1800° F. It was recognized that a temperature range of about 1700°–1900° F. is required for the method of the present invention: at 1925° F., processing resulted in sintering; below about 1700° F. insufficient Cr transport occurs. In the practice of the present invention for the deposition of Cr, the halide activator $NH_4Cl$ is preferred to the fluoride form of activator because use of fluorides of $NH_4$, Cr or Al resulted in sintering, or more rapid Al transport where Al fluorides were used, or they were hygroscopic. Therefore, when Cr is used in the practice of the present invention it is preferred that the coating powder mixture consist, by weight, essentially of 2–10% Cr, 1–10% and preferably 5–10% $NH_4Cl$, with the balance the above-described nonuniform powder size blend of an inert filler for use in the temperature range of about 1700°–1900° F.

The following Table I summarizes some of the above-described example data generated during evaluation of the present invention.

TABLE I

COATING APPLIED TO AN INNER WALL SURFACE OF A PASSAGE WITHIN A TURBINE BLADE OF RENE' 80 NI-BASE SUPERALLOY[a]

| Example | Coating Source Powder by wt, bal $Al_2O_3$ powder blend | Activator wt % | Temp. (°F.) | Time (hrs) | Coating Thickness (mils) |
|---|---|---|---|---|---|
| 1 | 2% $Fe_2Al_5$ | 0.3$NH_4F$ | 1925 | 4 | 0.5 |
| 2 | 5% $Fe_2Al_5$ | 0.3$NH_4F$ | " | " | 1. |
| 3 | 10% $Fe_2Al_5$ | 0.5$NH_4F$ | " | " | 1.5 |
| 4 | 15% | 0.5$NH_4F$ | " | " | 2. |
| 5 | 4% Al—Ti—C[b] | 0.1 $NH_4F$ | " | " | 0.5 |
| 6 | 0.1% Al[c] | 3 AlF + 0.5$NH_4F$[d] | " | " | 0.25 |
| 7 | 5% Cr | 5% $NH_4Cl$ | 1800 | 6 | 0.3 |
| 8 | 10% Cr | " | " | " | 0.4 |

[a]U.S. Pat. No. 3,615,376
[b]U.S. Pat. No. 3,540,878 (Codep B Powder)
[c]100% - Research Grade Powder
[d]$AlF_3$Anhydrous

EXAMPLE 9

In another evaluation of the present invention, an MCrAl-type coating was generated on a passage inner wall surface of the superalloy used in the examples of Table I. The letter "M" is intended to represent one or more elements selected from Fe, Ni and Co. Typical of such an internal coating was one generated by first applying a 0.8 mil thick Ni coating by an electroless nickel process, in this example, using hydrazine as a reductant. Thereafter, in sequence, Cr was applied according to Example 7 and Al was applied as in Example 1, of Table I. If desired, the coating source powder of Example 1 can be modified to include other elements such as Hf, typical of other reported additions to the MCrAl-type coating. In one example, 0.75 wt % Hf was added to a coating source powder including 2 wt % $Fe_2Al_5$ as in example 1, as an external coating. In this example 9, the above-described, layered coating was aged at about 1550° F. for about 16 hours to provide a uniform coating of about 2.5 mils in thickness.

As was mentioned above, one of the important features of the present invention is the control of the coating rate through use of a nonuniform filler powder predominantly in the size range of +325 mesh to −140 mesh. During the evaluation of the present invention, it was recognized that all +100 mesh powder resulted in too rapid a deposition, and all 325 mesh or smaller powder resulted in too slow a deposition rate along with agglomeration as a result of the too close proximity of the coating source powder. Notwithstanding the fact that there are some larger particle sizes in the nonuniform powder size blend, within the above-described blend range, the inert powder filler is sufficiently fluid after coating use so that it can be removed, such as by vibration, from within the interior of the article being coated. In the above-described examples, the alumina used as the inert filler powder included a nonuniform blend of 80–98% of the powder in the size range of +140 to −325. The alumina sieve analysis of one powder used in the evaluation of the present invention is shown in the following Table II which included about 95 weight % in such size range.

TABLE II

ALUMINA SIEVE ANALYSIS

| Mesh Size | Wt % |
|---|---|
| +100 | 0.1 |
| −100 + 140 | 0.5 |
| −140 + 200 | 24.1 |
| −200 + 270 | 52.7 |
| −270 + 325 | 18.4 |
| −325 + 400 | 1.1 |
| −400 | 1.9 |
| Fines & oversize | 1.2 |

Thus, the present invention teaches a method and an improved coating powder mixture for applying a metallic coating to an inner wall surface of a fluid-cooled turbomachinery blading member. According to the invention, coating rate is controlled through a nonuniform distribution of inert filler powder which, at the same time, enables easy removal of the coating powder mixture after coating has been completed.

The present invention can be used in the repair of fluid-cooled passages or air-cooling surface or exit openings through a wall, or their combinations, in turbomachinery blading members. For example, residue, generally oxides and sulfides, can accumulate in and cause erosion to such surfaces after high temperature exposure. Upon removal of such residue, the size of such eroded, corroded passages and openings can be oversize, thereby changing the cooling airflow characteristics through and out of such member. Use of the coating method associated with the present invention enables build-up and repair of such oversize, eroded surfaces. After coating, if the fluid-cooling exit openings are undersize, they can be subjected to a material removal process, for example, by drilling using mechanical, electrolytic, electrodischarge, laser or electron beam means for resizing.

Although the present invention has been described in connection with specific examples and embodiments, it will be recognized by those familiar with the coating art that the present invention is capable of a variety of modifications within its scope. For example, inert filler materials other than alumina, and which are stable at the intended coating temperatures, can be used. In addition, a variety of coating source powders can be employed in the coating powder mixture. It is intended to include such modifications within the scope of the appended claims.

What is claimed is:

1. In a method for applying a metallic coating to a fluid-cooled turbomachinery blading member of an alloy based on an element selected from the group consisting of Co, Ni and their mixtures, the member including an end portion and an airfoil portion connected with the end portion, the airfoil portion including an inner wall surface defining a fluid-cooling passage, the end portion including an end channel therethrough communicating with the fluid-cooling passage, the metallic coating being deposited from a coating powder mixture comprising a coating source powder, a halide activator and an inert filler powder wherein:

a substantially dry coating powder mixture is provided with an inert filler powder having a nonuniform powder size blend which varies predominantly within the range of +325 mesh to −140 mesh;

disposing the coating powder mixture in the end channel, adjacent the fluid-cooling passage;

mechanically retaining the powder mixture in the end channel; and then, heating the article and mixture in a nonoxidizing atmosphere at a temperature and for a time sufficient to react the coating source powder and the activator to generate from the coating source powder a coating vapor within the end channel and within the adjacent fluid-cooling passage, the coating vapor within the fluid-cooling passage contacting the passage inner wall surface to deposit thereon the metallic coating.

2. The method of claim 1 in which the coating powder mixture comprises a mixture of the inert filler powder blend and a powder of a metallic coating vapor source selected from the group consisting of Al, compounds of Al and alloys including Al.

3. The method of claim 2 in which the coating powder mixture comprises a mixture, by weight, of 80–98% nonuniform alumina blend as the inert filler powder; 2–20% $Fe_2Al_5$ as the coating source powder; and 0.1–1% $NH_4F$ as the halide activator;

and the temperature of heating is in the range of 1900°–2000° F.

4. The method of claim 1 in which the coating powder mixture comprises a mixture of the nonuniform inert filler powder blend and a powder of a metallic coating vapor source selected from the group consisting of Cr, compounds of Cr and alloys including Cr.

5. The method of claim 4 in which the coating powder mixture comprises, by weight, about 2–10% Cr metal powder as the coating source, 1–10% $NH_4Cl$ as the halide activator, with the balance alumina in the nonuniform size blend;

the heating in a nonoxidizing atmosphere being conducted at a temperature in the range of about 1700°–1900° F.

6. In a method for repairing a fluid-cooling passage of a fluid-cooled turbomachinery blading member having an airfoil portion including an inner wall surface defining the fluid-cooling passage, the turbomachinery blading member having experienced operating conditions to deposit residue within the fluid-cooling passage, the steps of:

removing residue from the fluid-cooling passage; and then applying a metallic coating to the inner wall surface by the method of claim 1.

7. The method of claim 6 for repairing fluid-cooling passage exit openings through a wall of the turbomachinery blading member, wherein, after coating, the exit openings are subjected to a material removal process for resizing the opening.

* * * * *